US011725909B2

(12) United States Patent
Kowalczyk, Jr. et al.

(10) Patent No.: US 11,725,909 B2
(45) Date of Patent: Aug. 15, 2023

(54) FIREARM ASSOCIATED ELECTRONIC DEVICE WITH ACCELERATION RESISTANT LATCH

(71) Applicant: Crosman Corporation, Bloomfield, NY (US)

(72) Inventors: John A. Kowalczyk, Jr., Fairport, NY (US); Jeffrey D. Hanson, West Henrietta, NY (US); Jeffrey W. Mock, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 198 days.

(21) Appl. No.: 17/129,567

(22) Filed: Dec. 21, 2020

(65) Prior Publication Data

US 2021/0278175 A1 Sep. 9, 2021

Related U.S. Application Data

(63) Continuation of application No. 14/988,400, filed on Jan. 5, 2016, now Pat. No. 10,871,349.

(Continued)

(51) Int. Cl.
*F41G 11/00* (2006.01)
*F41A 35/00* (2006.01)

(Continued)

(52) U.S. Cl.
CPC ..... *F41G 11/00* (2013.01); *F41A 11/00* (2013.01); *F41A 35/00* (2013.01); *F41C 27/00* (2013.01);

(Continued)

(58) Field of Classification Search
CPC ... F41G 11/00; F41G 1/34; F41G 1/35; F41A 11/00; F41A 35/00; F41C 27/00;

(Continued)

(56) References Cited

U.S. PATENT DOCUMENTS 4,050,272 A 9/1977 Tanaka
4,206,274 A * 6/1980 Peels ..... H01M 50/213 429/100

(Continued)

OTHER PUBLICATIONS

LaserMax,Inc., "UNI(TM) Rail Mounted Lasers Operator's Manual", available at <<https://www.lasermax.com/pub/media/Im_files/1461196800_unimanual.pdf>>, 14 pages.

(Continued)

*Primary Examiner* — Christine M Mills
*Assistant Examiner* — Faria F Ahmad
(74) *Attorney, Agent, or Firm* — Lee & Hayes, P.C.

(57) ABSTRACT

Firearm associated electronic devices are provided. In one aspect a firearm associated device has a housing having a holding area and an opening through which a removable component may be positioned in the holding area, a door movable relative to the housing and having a door latch that moves along a path as the door moves and a housing latch movable between a first latch position where the housing latch is not in the path to a second latch position where the housing latch blocks movement of the door latch from a first range of positions where the door prevents the removable component from passing through the opening to a second range of positions where the door does not prevent the removable component from passing through the opening. A housing latch biasing member biases the housing latch into the second latch position. When the door latch is in the first range of positions and the housing latch is in the second latch position the door latch is movable along the path but is blocked by the housing latch from passing to the second range of positions.

16 Claims, 11 Drawing Sheets

Related U.S. Application Data

(60) Provisional application No. 62/099,879, filed on Jan. 5, 2015.

(51) Int. Cl.

| | |
|---|---|
| ***F41G 1/34*** | (2006.01) |
| ***F41C 27/00*** | (2006.01) |
| ***F41A 11/00*** | (2006.01) |
| ***F41G 1/35*** | (2006.01) |

(52) U.S. Cl.
CPC ..... *F41G 1/34* (2013.01); *F41G 1/35* (2013.01); *Y10T 292/0825* (2015.04); *Y10T 292/0862* (2015.04); *Y10T 292/0863* (2015.04); *Y10T 292/0911* (2015.04); *Y10T 292/0913* (2015.04); *Y10T 292/1043* (2015.04); *Y10T 292/1049* (2015.04)

(58) Field of Classification Search
CPC ..... Y10T 292/0825; Y10T 292/0862; Y10T 292/0863; Y10T 292/0911; Y10T 292/0913; Y10T 292/1043; Y10T 292/01
See application file for complete search history.

(56) References Cited

U.S. PATENT DOCUMENTS

| | | | | |
|---|---|---|---|---|
| 4,269,908 | A * | 5/1981 | Stemme | H01M 50/216 429/100 |
| 4,391,883 | A * | 7/1983 | Williamson | H01M 50/213 429/97 |
| 4,434,635 | A | 3/1984 | Borgato | |
| 4,915,428 | A | 4/1990 | Hayakawa | |
| 5,337,215 | A * | 8/1994 | Sunderland | H01M 50/213 429/97 |
| 5,413,499 | A | 5/1995 | Wright, Jr. et al. | |
| 5,498,039 | A | 3/1996 | Bivens | |
| 5,508,124 | A | 4/1996 | Gordecki et al. | |
| 5,595,409 | A | 1/1997 | Fier et al. | |
| 5,714,716 | A * | 2/1998 | Yamada | H01M 50/216 174/541 |
| 5,752,595 | A | 5/1998 | Fein et al. | |
| 5,820,406 | A | 10/1998 | Hetherington | |
| 6,079,756 | A | 6/2000 | Phillips | |
| 6,117,575 | A | 9/2000 | Dinsdale | |
| 6,616,199 | B1 | 9/2003 | Tokach et al. | |
| 7,029,040 | B2 | 4/2006 | Lippoldt et al. | |
| 7,178,839 | B2 | 2/2007 | Tsai | |
| 7,255,375 | B2 | 8/2007 | Heid et al. | |
| 7,427,086 | B2 | 9/2008 | Park et al. | |
| 7,492,273 | B2 | 2/2009 | Sharpe et al. | |
| 7,583,500 | B2 | 9/2009 | Ligtenberg et al. | |
| 7,743,547 | B2 * | 6/2010 | Houde-Walter | F41G 11/003 42/114 |
| 8,109,541 | B2 | 2/2012 | Chang et al. | |
| 8,376,478 | B2 | 2/2013 | Weber et al. | |
| 8,408,607 | B2 | 4/2013 | Michael et al. | |
| 8,899,636 | B2 | 12/2014 | Fitzgerald et al. | |
| 9,068,801 | B1 * | 6/2015 | Stecher, Jr. | F41G 11/00 |
| 9,897,407 | B2 | 2/2018 | Kramer | |
| 9,963,913 | B2 | 5/2018 | Howell et al. | |
| 9,979,871 | B2 | 5/2018 | Kennair, Jr. | |
| 10,568,470 | B2 * | 2/2020 | Kling | A47K 10/3625 |
| 2004/0229113 | A1 | 11/2004 | Sharpe et al. | |
| 2004/0242042 | A1 | 12/2004 | Buck et al. | |
| 2005/0073283 | A1 | 4/2005 | Friedli et al. | |
| 2005/0121918 | A1 | 6/2005 | Smock et al. | |
| 2006/0119108 | A1 | 6/2006 | Heid et al. | |
| 2007/0138806 | A1 | 6/2007 | Ligtenberg et al. | |
| 2008/0112698 | A1 | 5/2008 | Ray | |
| 2008/0142522 | A1 | 6/2008 | Maid | |
| 2009/0255084 | A1 | 10/2009 | Gee, II et al. | |
| 2010/0053857 | A1 | 3/2010 | Zhu et al. | |
| 2012/0312594 | A1 | 12/2012 | Hapke et al. | |
| 2013/0235562 | A1 | 9/2013 | Chauvie | |
| 2014/0322673 | A1 | 10/2014 | Uhr | |
| 2015/0241169 | A1 | 8/2015 | Cheng et al. | |
| 2015/0369554 | A1 | 12/2015 | Kramer | |
| 2016/0195366 | A1 | 7/2016 | Kowalczyk et al. | |
| 2016/0201363 | A1 | 7/2016 | Akahori et al. | |
| 2016/0209169 | A1 | 7/2016 | Toole | |
| 2016/0327371 | A1 | 11/2016 | Teetzel et al. | |
| 2017/0176140 | A1 | 6/2017 | Harrison | |
| 2018/0023910 | A1 | 1/2018 | Kramer | |
| 2018/0364009 | A1 | 12/2018 | Hancosky | |
| 2020/0158473 | A1 | 5/2020 | Wells et al. | |
| 2020/0300580 | A1 | 9/2020 | Kowalczyk, Jr. et al. | |

OTHER PUBLICATIONS

Office Action for U.S. Appl. No. 14/988,400, dated Dec. 31, 2019, Kowalczyk, "Firearm Associated Electronic Device With Acceleration Resistant Latch", 15 pages.

Office action for U.S. Appl. No. 14/988,400, dated May 1, 2019, Inventor #1, "Firearm Associated Electronic Device With Acceleration Resistant Latch", 12 pages.

* cited by examiner

FIREARM ASSOCIATED ELECTRONIC DEVICE WITH ACCELERATION RESISTANT LATCH

CROSS-REFERENCE TO RELATED APPLICATIONS

This Application is a continuation of and claims priority to U.S. patent application Ser. No. 14/988,400, filed Jan. 5, 2016, now U.S. Pat. No. 10,871,349, issued Dec. 22, 2020, which claims the benefit of U.S. Provisional Application No. 62/099,879, filed Jan. 5, 2015, which are incorporated herein by reference.

FIELD OF THE INVENTION

The present invention relates to the field of firearm associated electronic devices and more particularly to firearm associated electronic devices that are associated with firearms and that have removable components that must be securely held during firearm use and discharge but conveniently released when desired.

BACKGROUND

Associating firearm associated electronic devices with firearms has always been a challenging task in that the firearm associated electronic devices must be capable of surviving extreme levels of rapid acceleration during firearm discharge as well as rough handling between uses. Replaceable elements such as batteries and memory cards present a particular challenge for use with such devices as they require replacement or substitution. This requires that the replaceable elements be mounted in a fashion that secures the replaceable elements to the firearm associated electronic device in a way that is not disrupted even temporarily by the extreme accelerations experienced during firearm discharge.

Additionally, there is a need to protect against inadvertent release of the replaceable component such as by incidental contact between latching mechanisms of the firearm associated electronic devices and adjacent objects such as holsters during transport of the firearm.

Accordingly, fasteners are often used to secure replaceable components under such circumstances. For example, the LaserMax LMS-UNI-MAX RED sold by LaserMax, Inc. uses a pair of screws to secure a battery door to the laser housing. However, given that consumers typically prefer firearm associated electronic devices that are as small as possible, it is typically necessary that such fasteners be small. Such small fasteners are easily lost and can be difficult to manipulate except under controlled circumstances. Often removal and replacement of such fasteners requires the use of a tool that may not available when needed. Accordingly, it can be a complex and inordinately time-consuming task to replace such components.

What is needed in the art is a firearm associated electronic device for use with a firearm that can effectively hold a replaceable component against both the extreme accelerations experienced during firearm discharge and also against inadvertent release of the replaceable component, while also providing a quick, intuitive, tool and fastener free way to remove and install the replaceable component.

SUMMARY OF THE INVENTION

Firearm associated electronic devices are provided. In one aspect a firearm associated device has a housing having a holding area and an opening through which a removable component may be positioned in the holding area, a door movable relative to the housing and having a door latch that moves along a path as the door moves and a housing latch movable between a first latch position where the housing latch is not in the path to a second latch position where the housing latch blocks movement of the door latch from a first range of positions where the door prevents the removable component from passing through the opening to a second range of positions where the door does not prevent the removable component from passing through the opening. A housing latch biasing member biases the housing latch into the second latch position. When the door latch is in the first range of positions and the housing latch is in the second latch position the door latch is movable along the path but is blocked by the housing latch from passing to the second range of positions.

DETAILED DESCRIPTION OF THE INVENTION

The drawings provided are for illustration purposes and may not be to scale.

Figure 1:
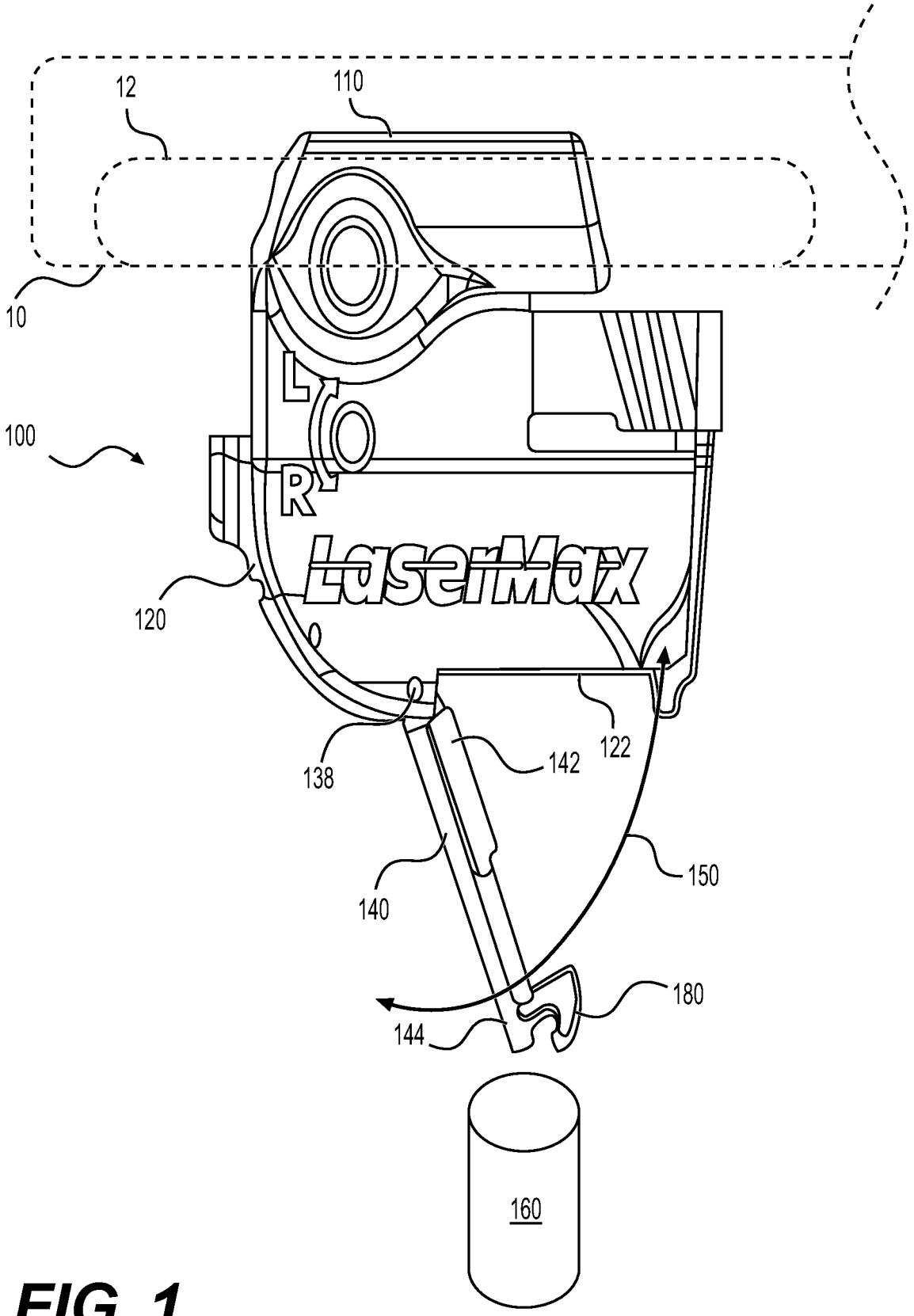
FIG. 1 illustrates a left side elevation view of one embodiment of a firearm associated electronic device having a battery door shown in an open position.

FIG. 1 shows a first embodiment of a firearm associated electronic device 100 for use with a firearm 10. In this embodiment, firearm 10 has a rail 12 such as a Picatinny Rail or Weaver rail or any other known form of firearm mounting surface to which an external device can be joined. Firearm associated electronic device 100 has a rail mount 110 that is co-designed or otherwise adapted or adaptable for use with rail 12 and that allows firearm associated electronic device 100 to be securely mounted to firearm 10. Any other known structure or system that allows firearm associated electronic device 100 to be securely joined, mounted integrated or otherwise physically associated with firearm 10 can also be used. In other embodiments, firearm associated electronic device 100 may be integrally incorporated into components of firearm 10 such as a grip (not shown), handle (not shown), frame (not shown), mounting rail or other component of firearm 10.

Figure 2:
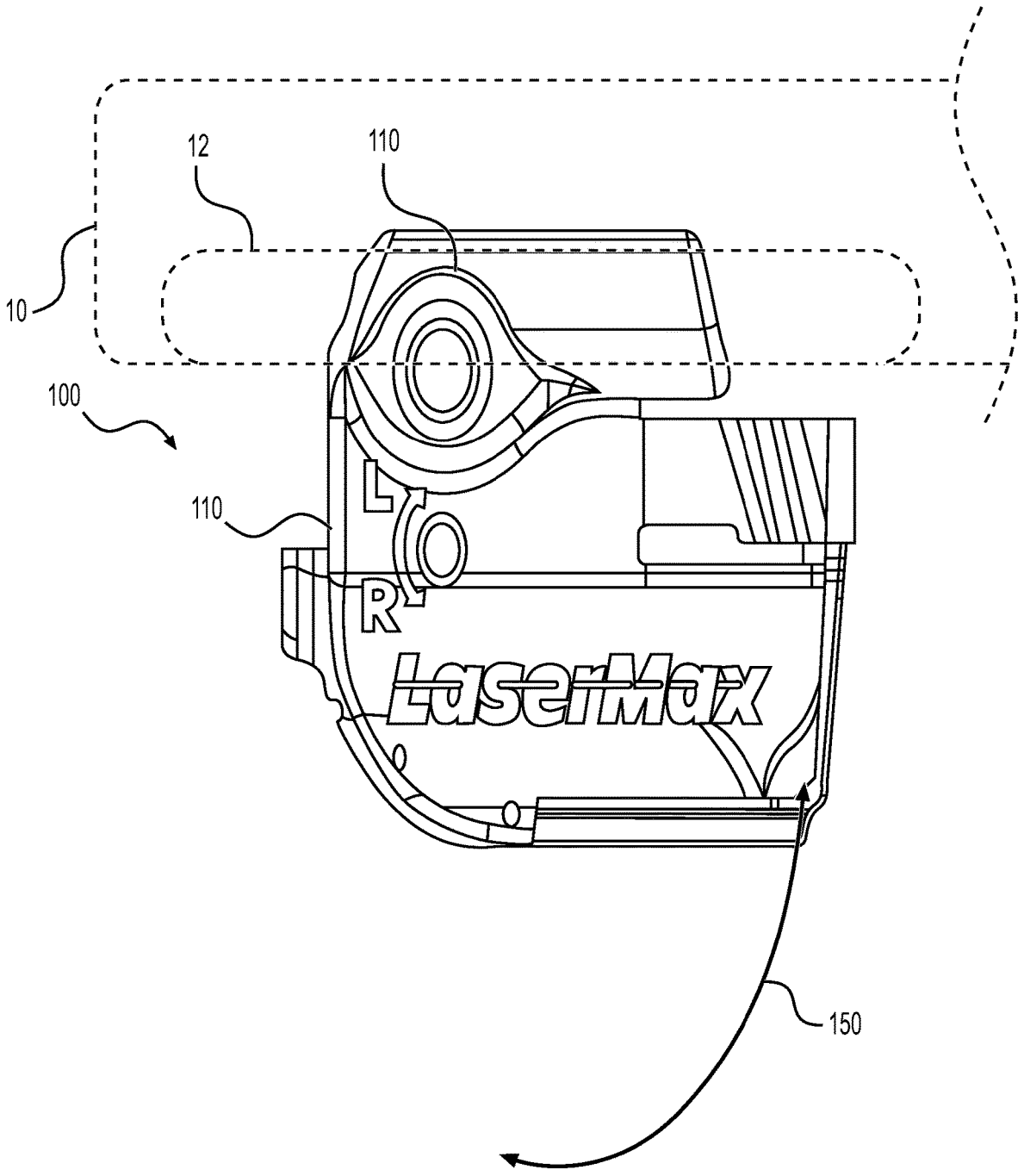
FIG. 2 illustrates a left side elevation view of one embodiment of a firearm associated electronic device for use with a firearm having a battery door shown in a closed position.

As is shown in FIG. 1, firearm associated electronic device 100 has a housing 120 with an opening 122 and a door 140. In the embodiment of FIG. 1, a hinge 138 joins housing 120 to a hinge end 142 of door 140 such that door 140 is pivotally movable along a path 150 through a range of positions that include but are not limited to the position illustrated in FIG. 1, at least one loading position at which door 140 is positioned so that a battery 160 or other removable component can be inserted into or removed from an opening 122 in housing 120 and a latched position as shown in FIG. 2 at which door 140 and housing 120 are latched together to hold battery (not shown in FIG. 2) in housing 120.

Figure 3:
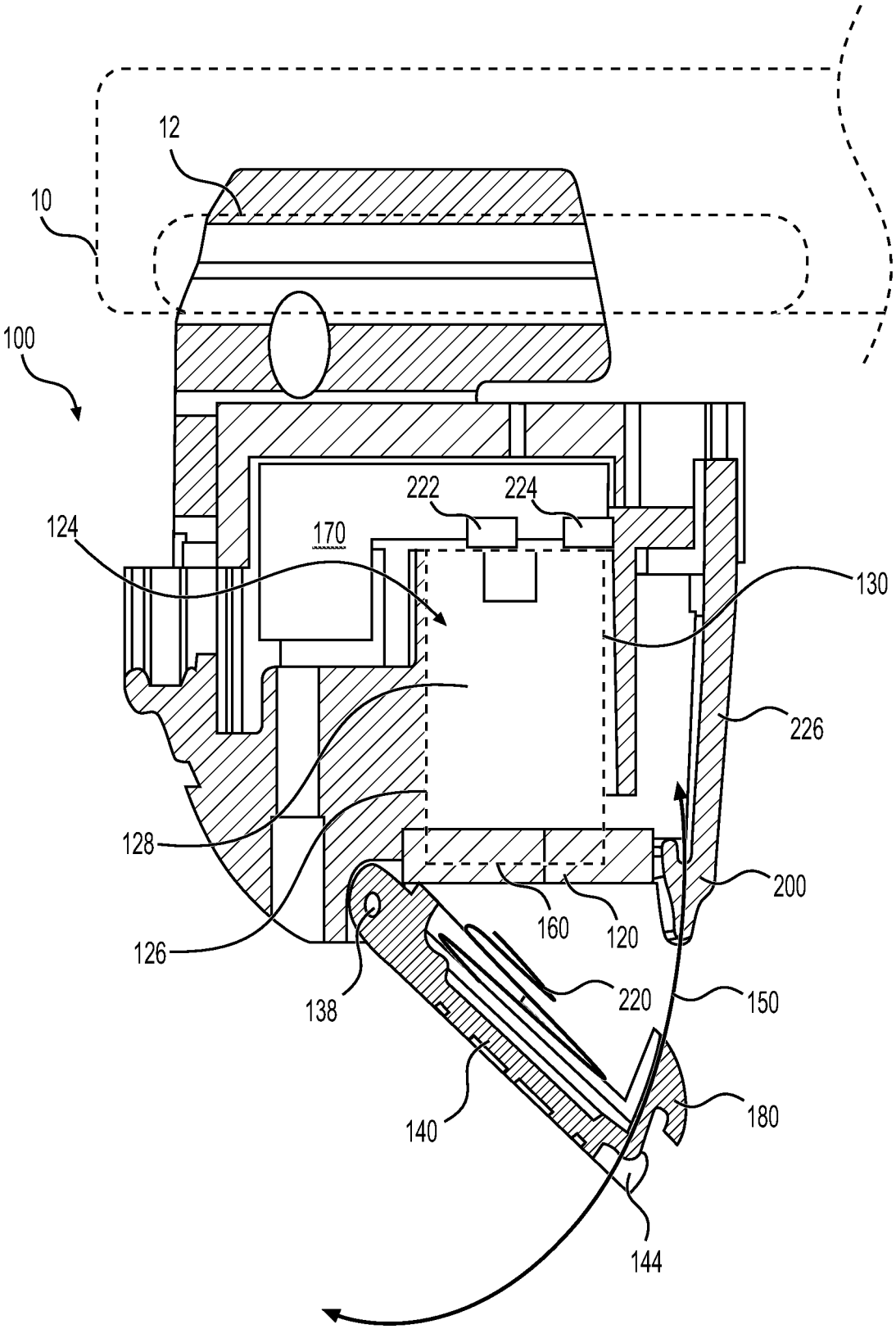
FIG. 3 shows a cross-section view of the firearm mounted firearm associated electronic device of FIGS. 1 and 2 with the battery door in an open position.

FIG. 3 illustrates firearm associated electronic device 100 in cross-section. As is shown in FIG. 3, opening 122 allows battery 160 to pass into and out of a holding area 124 that is sized to receive and to restrict movement of battery 160 when door 140 is in the latched position. Holding area 124 has containment surfaces shown in this view as sidewalls 126, 128 and 130 that cooperate to define boundaries of holding area 124 to allow battery 160 to be held within holding area 124 and to cooperate as necessary with electronics 170 that are located in firearm associated electronic device 100. For the purposes of FIG. 3, electronics 170 are illustrated in block form and the relative size and location of electronics 170 is provided merely for illustration purposes and may in application vary from that illustrated here in any or all of location, shape, orientation and relative size.

Battery 160 is shown in phantom in FIG. 3 and electrical connections between battery 160 and electronics 170 are provided by conductors 222 and 224. In this embodiment, battery 160 is biased into contact with conductors 222 and 224 by a biasing force supplied by a spring 220. Spring 220 is positioned between battery 160 and door 140 and spring 220 is compressed between battery 160 and door 140 as door 140 is closed. Spring 220 resists such compression by providing the bias force that biases battery 160 into contact with electrical conductors 222 and 224 when door 140 is in the closed position.

In the embodiment that is illustrated here spring 220 is shown in the form of a coil spring, however this is not limiting and other springs or materials that can provide a resilient bias can be used for this purpose.

As is can be seen in FIG. 3, a door latch 180 is positioned at a door latch end 144 of door 140 and a housing latch 200 is positioned on housing 120 at a position that is located within path 150 along which door 140 and door latch 180 must to travel into the closed position. One or both of door latch 180 and housing latch 200 are supported in a manner that allows one or both of door latch 180 and housing latch 200 to move in order to allow door 140 to close. In this embodiment, primary deflection comes from a housing resilient member 226 that allows housing latch 200 to be deflected out of path 150 of door latch 180 as door 140 is moved along path 150 in a closing direction. In other embodiments, door 140 can be arranged to support door latch 180 to provide primary deflection. In still other embodiments, hinge 138 can be mounted in a manner that allows resilient deflection of door latch 180. Such techniques may be used in combination.

Figure 4:
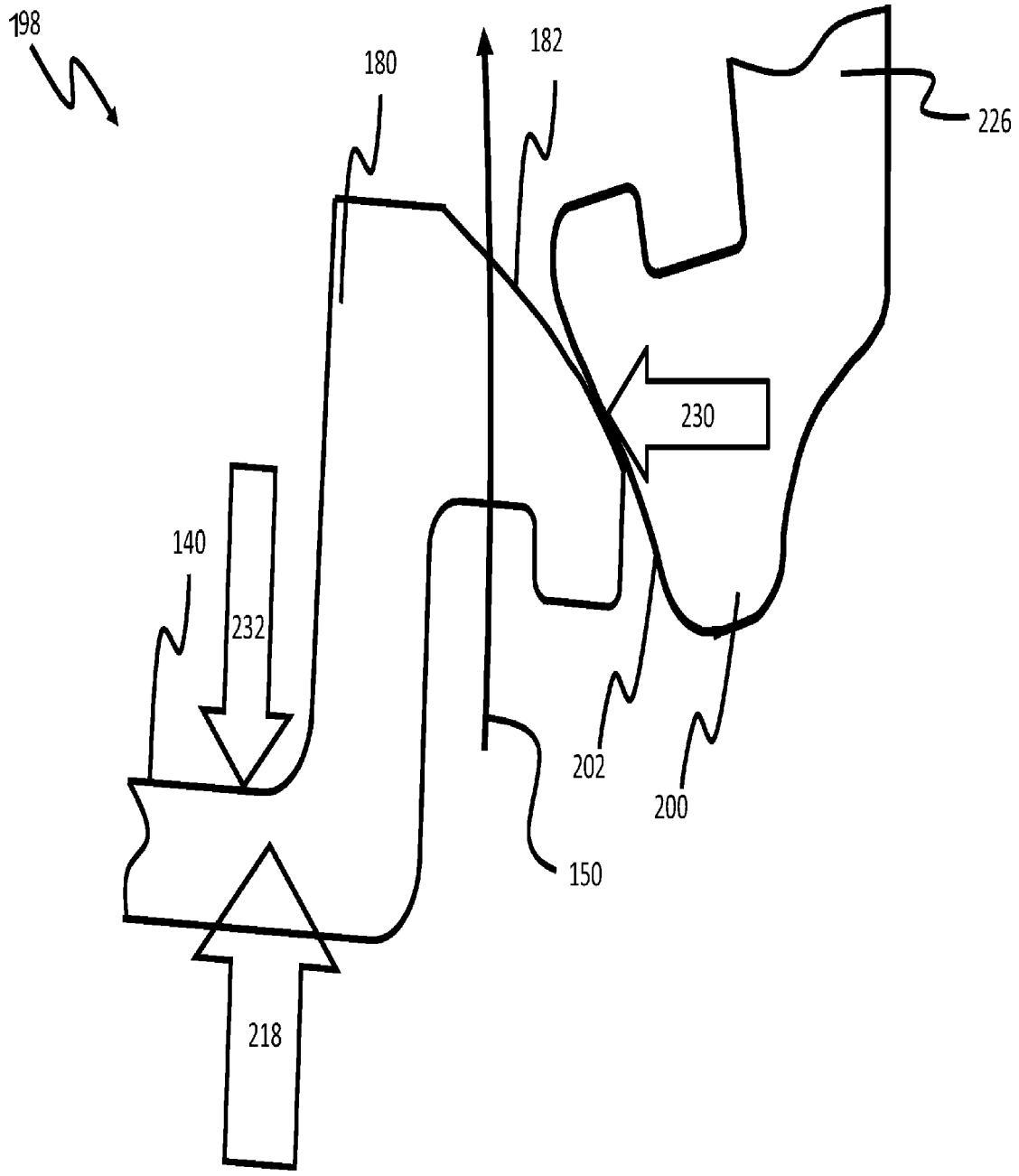
FIG. 4 is a side view of a latching system with a door, door latch, housing latch and housing bias member in a first position during closure.
Figure 5:
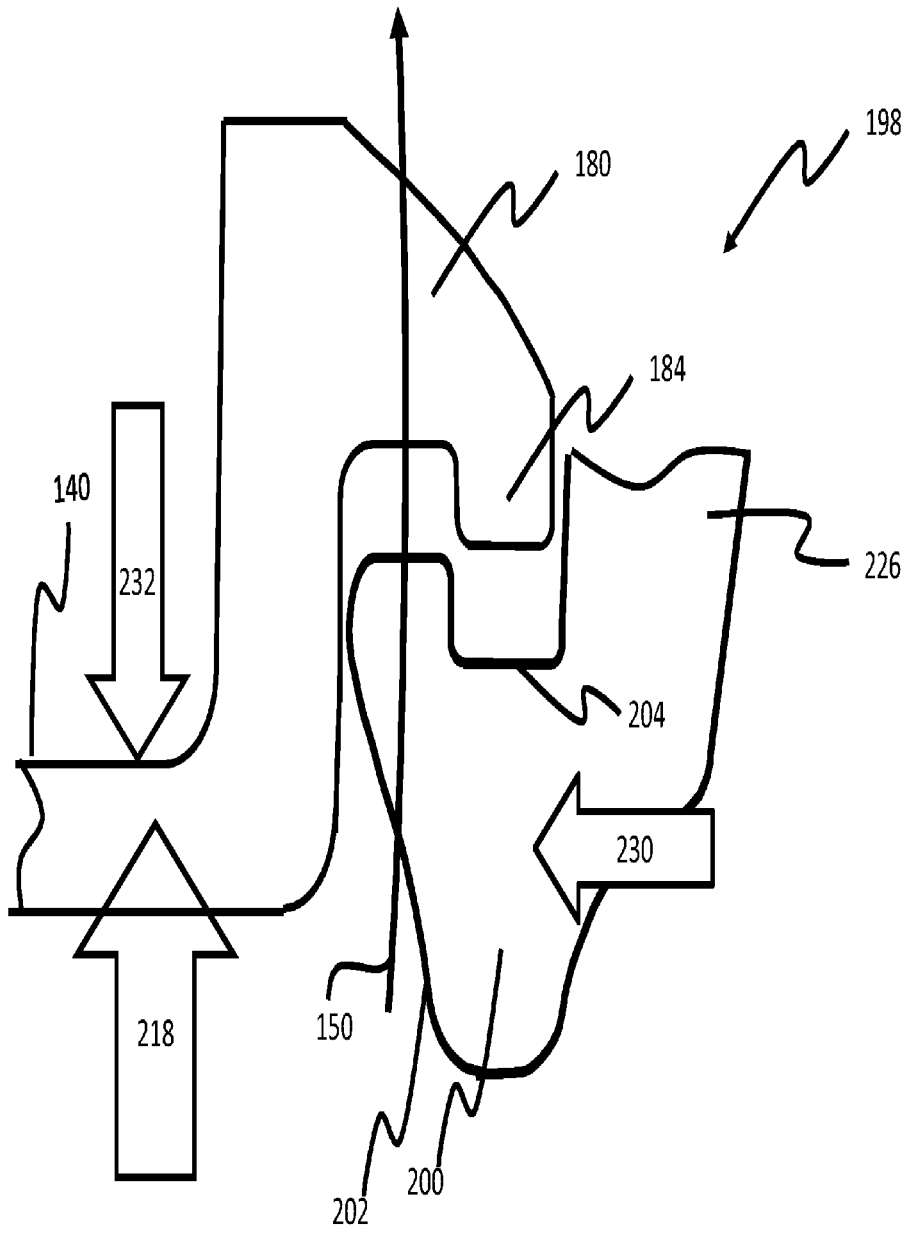
FIG. 5 is a side view of a latching system of FIG. 4 with a door, door latch, housing latch and housing bias member in a second position during closure.
Figure 6:
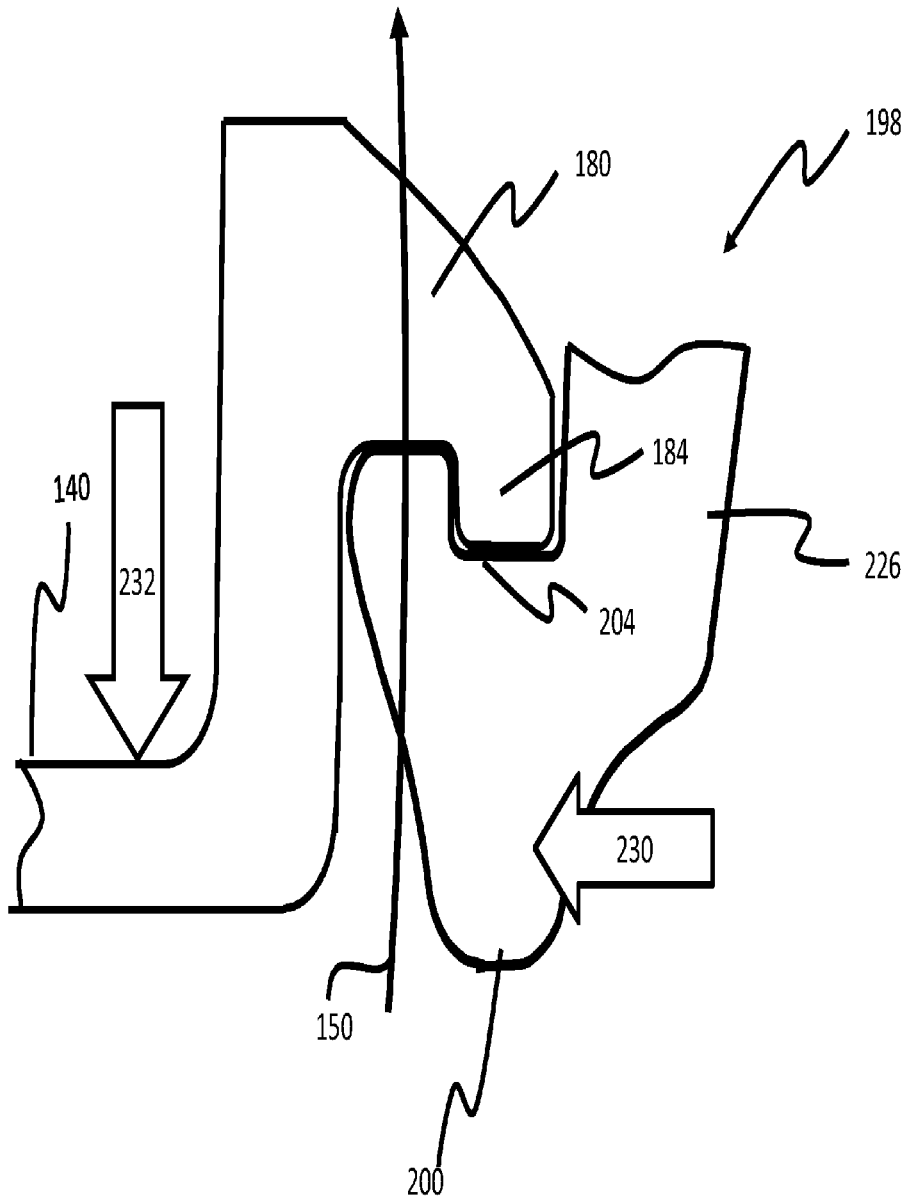
FIG. 6 is a side view of a latching system of FIG. 4 with a door, door latch, housing latch and housing bias member in a latched position.

FIGS. 4-6 illustrate the general operation of one embodiment of latching system 198 useful in firearm associated electronic device 100 using cutaway side views of door 140, door latch 180 and housing latch 200 and housing resilient member 226.

As is shown in FIG. 4, after a user has loaded battery 160 into storage or holding area 124 the user then applies a closure force 218 that urges door 140 in a closure direction along path 150. As door latch 180 is moved along path 150, door latch 180 is moved into contact with housing latch 200. In this embodiment, door latch 180 has at least one contact surface 182 and housing latch 200 has at least one contact surface 202 that are shaped at least in part to facilitate contact with each other such that there is little unnecessary friction or interference that would unduly resist movement of door latch 180 generally along path 150.

When door 140 is in the position illustrated in FIG. 4, housing latch 200 is urged from path 150 against a first bias 230 applied by housing resilient member 226. First bias 230 is overcome by closure force 218 to allow door 140 and door latch 180 to be moved to a position where contact surface 182 is no longer in contact with contact surface 202.

As is shown in FIG. 5, when door 140 and door latch 180 are moved so that contact surface 182 no longer engages contact surface 202 of housing latch 200, there is no further resistance to first biasing force 230 and housing latch 200 is propelled by first biasing force 230 into path 150. This creates a mechanical indication for the user of the firearm associated electronic device 100 that further movement of door 140 and door latch 180 is not necessary. Additional indicators such as mechanical stops can be used to block movement of door 140 and latch 180 when door 140 has been moved sufficiently.

As is described above, as door 140 is moved toward the position that is illustrated in FIG. 5, compression of spring 220 begins. Spring 220 resists compression by exerting force against battery 160 and door 140 and with respect to door 140 this creates a second bias 232 that urges door 140 against closure.

As is shown in FIG. 6, when a user ceases to apply loading force 218, second bias force 232 applied by spring 220 drives a door latch protrusion 184 along path 150 into a housing latch channel 204.

Door latch protrusion 184 and housing latch channel 204, in combination with first bias 230 and second bias 232 provide secure protection against unintended opening of door 140 caused by either high levels of transient acceleration as might be caused by firearm discharge recoil as well as against unintended opening of door 140 as might be caused by inadvertent contact with door 140 or housing latch 200.

Figure 7:
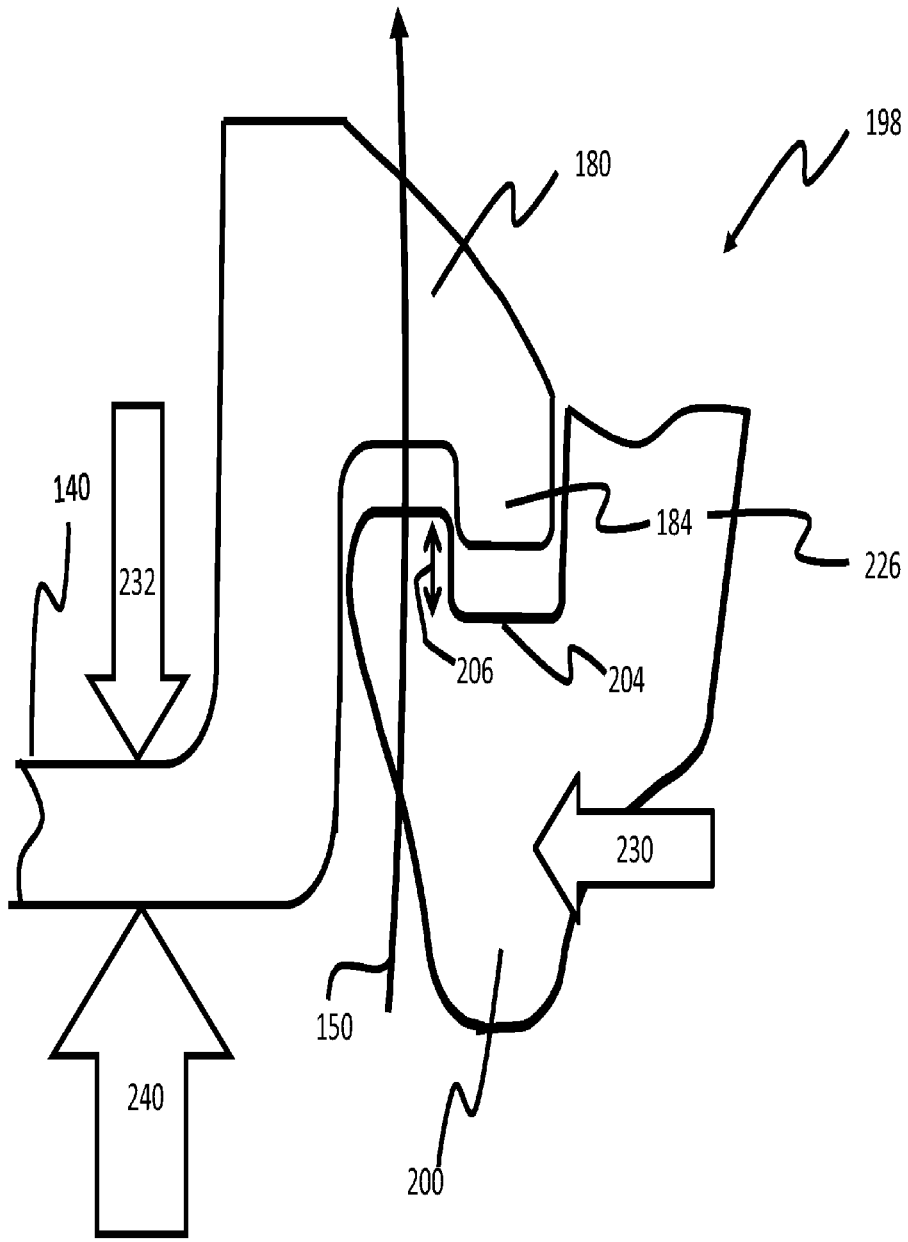
FIG. 7 illustrates the embodiment of FIG. 4 during an example firearm discharge.

For example, as is shown in FIG. 7, in the event of a firearm discharge, firearm associated electronic device 100 may experience a large vertical transient acceleration 240 during discharge or during the damping process. Some of the forces experienced by firearm associated electronic device 100 will be transferred through housing 120 to battery 160. However, to facilitate loading and unloading of battery 160, it is necessary to allow some freedom of movement of battery 160 within storage area 120. This in turn means that in certain respects, battery 160 will react to the transient accelerations in a manner that may be different than that of remaining components of firearm associated electronic device 100. In particular, under certain circumstances, the transient accelerations may be conveyed from the housing 120 to battery 160 by way of hinge 138, door 140, and spring 220. Further, the reaction of battery 160 to the forces applied will also be influenced by the characteristics of spring 220. Accordingly, it is quite possible that battery 160 will have a different reaction profile in response to such accelerations than housing 110, door 140 and other components of firearm associated electronic device 100. For example, battery 160 may, as a result of inertia, remain relatively stationary as housing 120 or door 140 reacts more rapidly to such accelerations.

The differences in the reaction profile may include but are not limited to moving at a different rate in response to the accelerations, moving in different directions in response to the accelerations, different damping frequencies, or different damping phase relationships. For example, it is possible that at some point following firearm discharge housing 120 will be moving in a first direction while battery 160 is moving in a second and opposite direction. It will also be appreciated that door 140 itself is hinged at one end but is freely movable at the other and is subject to similar outcomes, that is door 140 may move at a different rate or frequency than housing 110 during a firearm discharge causing door 140 to possibly move in different directions than housing 110 at times.

Figure 8:
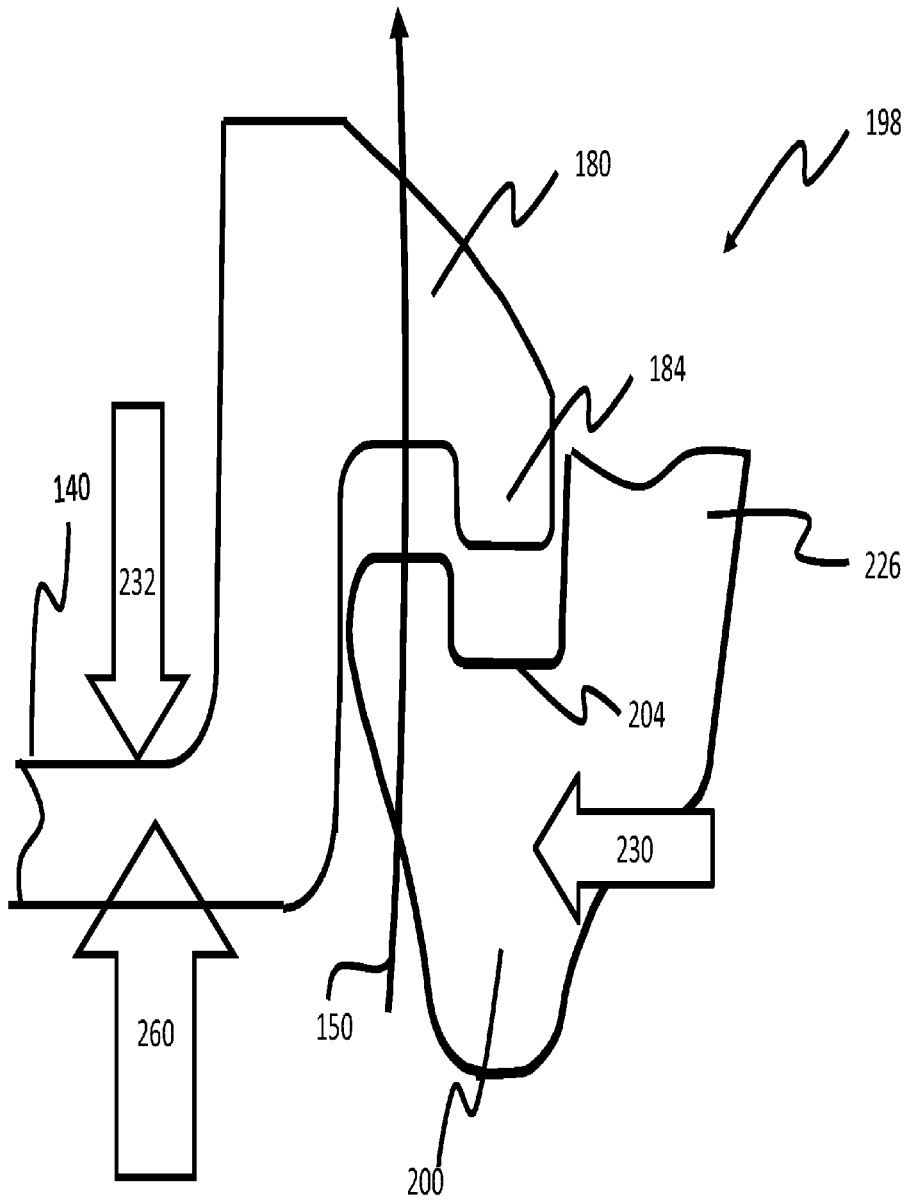
FIG. 8 illustrates the embodiment of FIG. 4 during an example firearm discharge.

It will be appreciated that where such things occur, door 140 and latch 180 may move within a height 206 of channel 204 as illustrated in FIG. 7, without creating a risk of inadvertent release of door 140. Further, even to the extent that door 140 and latch 180 move beyond height 206 there is no opportunity for this to cause an inadvertent release of door 140 as this merely returns door 140 and door latch 180 to a fully separated position as is illustrated in FIG. 8 and even where this happens housing resilient member 226 maintains housing latch 200 in path 150 at a position where second bias 232 will act to advance door 140 and door latch 180 along path 150 to bring door latch protrusion 184 into channel 204 again.

Accordingly, by virtue of this arrangement it becomes possible to provide a latch system that can maintain a latched arrangement between door 140 and housing 120 despite high levels of transient accelerations such as might be experienced by firearm associated electronic device 100 during discharge of firearm 10 or any subsequent recoil—without the use of fasteners.

Further, it will be appreciated that this arrangement also protects against inadvertent opening of door 140 as might be caused by incidental contact between firearm associated electronic device 100 and an external object such as a holster. Here again, it will be appreciated that inadvertent contact between door 140 and such an exterior object can have the effect of pressing door 140 such that door 140 and door latch 180 travel along path 150 in the direction of closing. Such inadvertent contact will either drive door 140 and door latch 180 such that 184 moves by less than distance 206 in which case door 140 will not open for the reasons that are discussed above with reference to FIG. 7. If door 140 moves by more than distance 206 door 140 will not open for the reasons discussed with reference to FIG. 5.

Alternatively, exterior forces caused by incidental contact with firearm associated electronic device 100 may be exerted against housing latch 200 however, so long as door latch protrusion 184 is positioned in channel 204, door latch 180 and door latch protrusion 184 will be capable of cooperating with channel 204 to prevent housing latch 200 from moving in response to such incidental forces.

Figure 9:
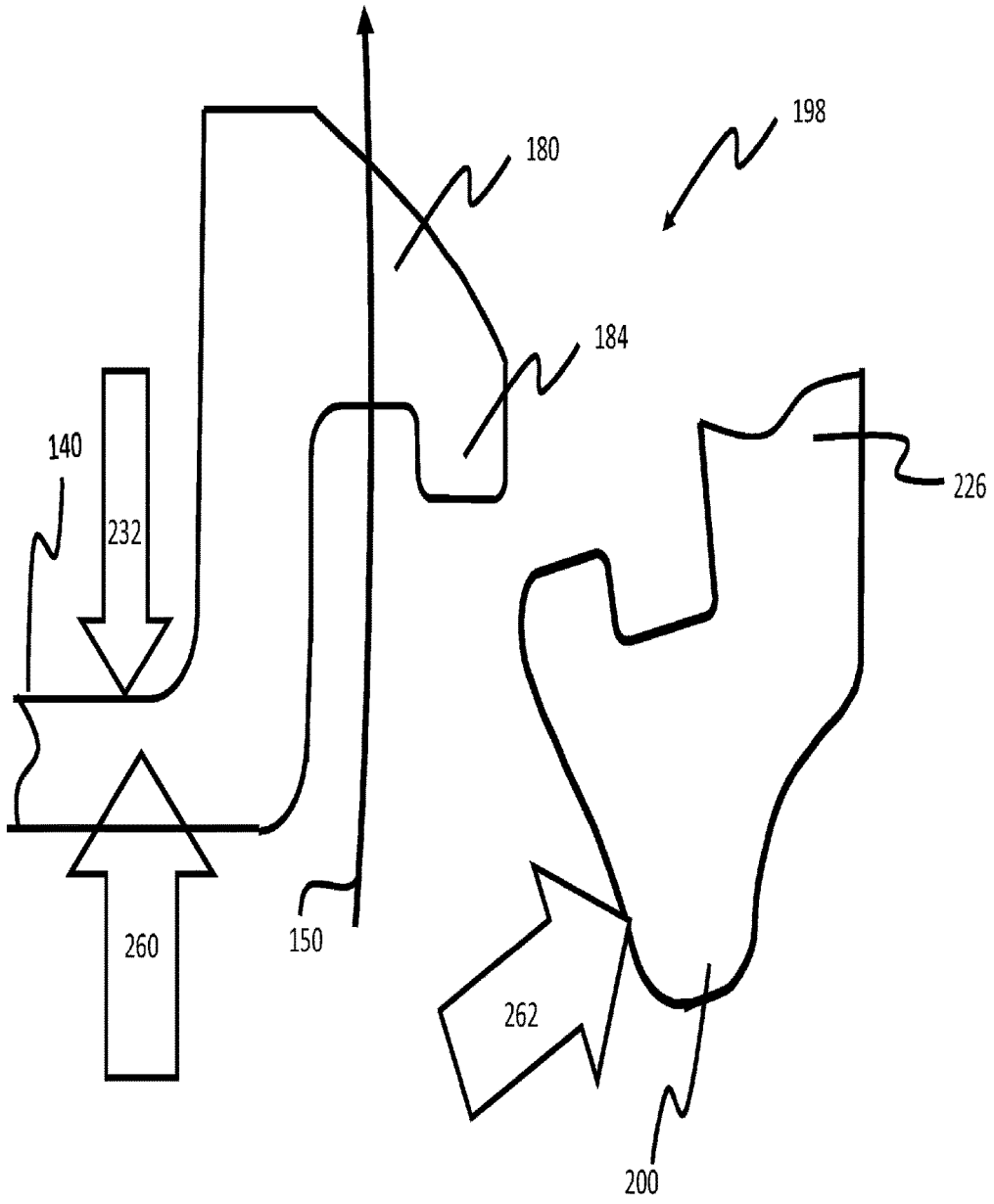
FIG. 9 illustrates forces applied to the embodiment of FIG. 4 to release the door.

Further, as is illustrated in FIG. 9, it will be understood that to open door 140 it is necessary to separate door latch 180 and housing latch 200 with a first force 260 applied along path 150 and this closure force must continue while a second force 262 is applied to housing latch 200 along a direction that is orthogonal to path 150. The closure force 218 must then end while the second force 262 continues to housing latch 200 from path 150 until door latch 180 has passed housing latch 200. Few if any inadvertent or incidental contacts will be capable of achieving such an outcome.

However, such protections against opening of door 140 in response to high transient accelerations and inadvertent contact do not make it more difficult for a user to manually release door 140 so that battery 160 can be replaced. As is shown in FIG. 9, a user of firearm associated electronic device 100 need only apply a first force 260 against door 140 that is sufficient to cause door latch protrusion 184 to move by an amount that is sufficient to separate from channel 204 and to hold door 140 in that position briefly. This can be done for example by one hand of a user while a second hand of a user can apply a second force 262 deflecting housing latch 200 out of path 150. With this done, first force 260 can be released so that second bias force 232 will drive door 140 open. In this way, door 140 of firearm associated electronic device 100 can be quickly and easily opened by a user intending to open door 140 to allow access to battery 160 or any other desired objection in storage area 120.

Figure 10:
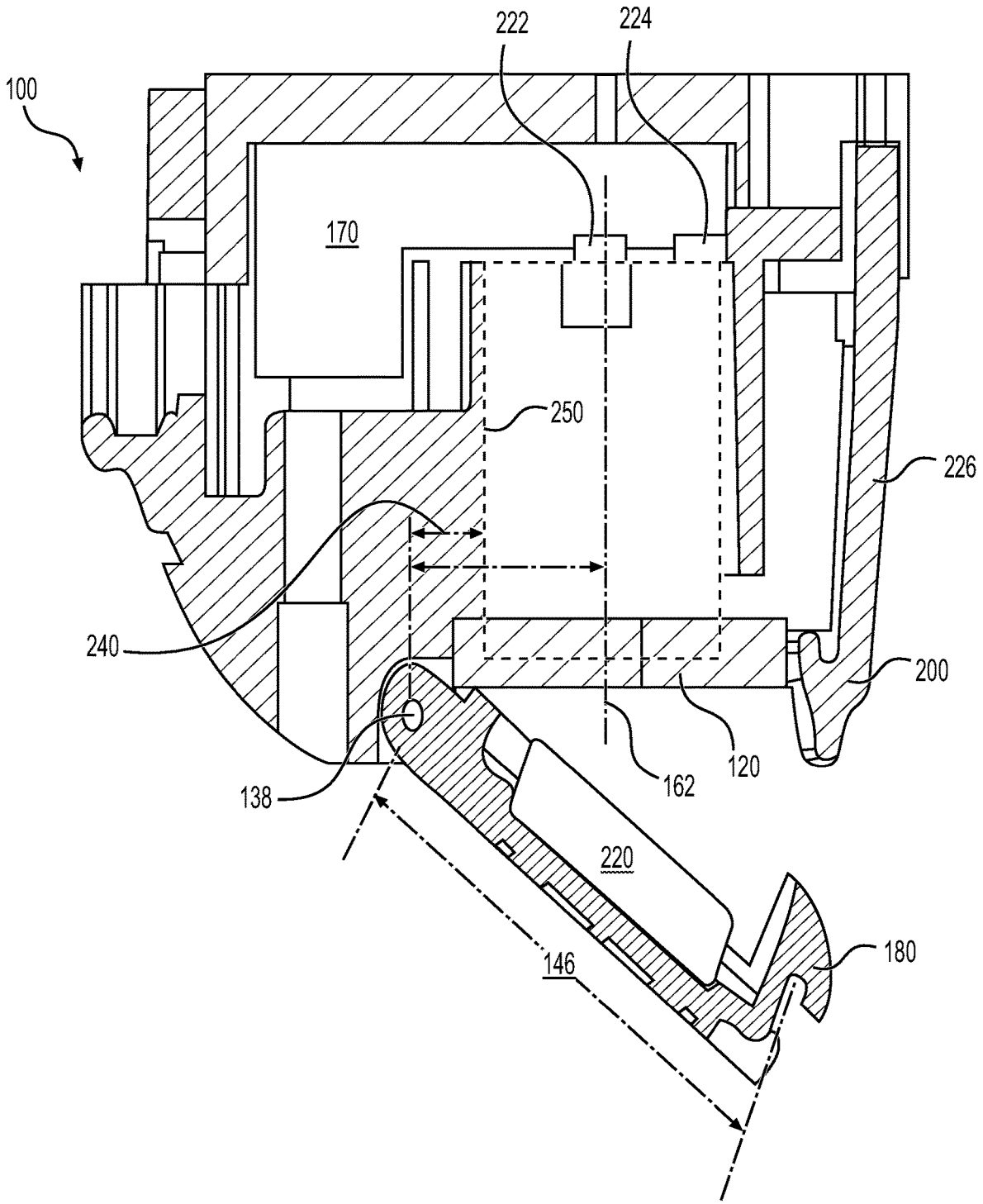
FIG. 10 is an enlarged view of firearm associated electronic device illustrating additional features of embodiments such as the embodiment of FIGS. 1-3.

FIG. 10 is an enlarged view of a portion of a firearm associated electronic device 100 illustrating additional features of embodiments such as the embodiment of FIGS. 1-3. As is shown in FIG. 10, firearm associated electronic device 100 has a housing 110 with hinge 138 located within a distance 240 proximate to an edge 250 of holding area 124. As shown here hinge 138 can be located between about 2 to 25 mm apart from edge 250. In other embodiments, hinge 138 can be located up about 35% of a length 146 of door 140 apart from edge 250.

It will be appreciated that by locating hinge 138 more proximate to edge 250, a distance 164 between the fulcrum provided by hinge 138 and a center of mass 162 of a battery 160 is reduced. Accordingly, hinge 138 is positioned to receive and channel a greater portion of any force applied by battery 160 than hinge 138 would receive in the event that hinge 138 were to be positioned further from edge 250. This reduces the amount of force that must be transmitted by door 140 and that must be managed at door latch 180 and housing latch 200. Additionally, this reduces length 146 of door 140 and allows greater design freedom in the design of door 140, door latch 180 and housing latch 200. Such additional design freedom can be used for example to provide additional functionality or to reduce cost or weight.

Figure 11:
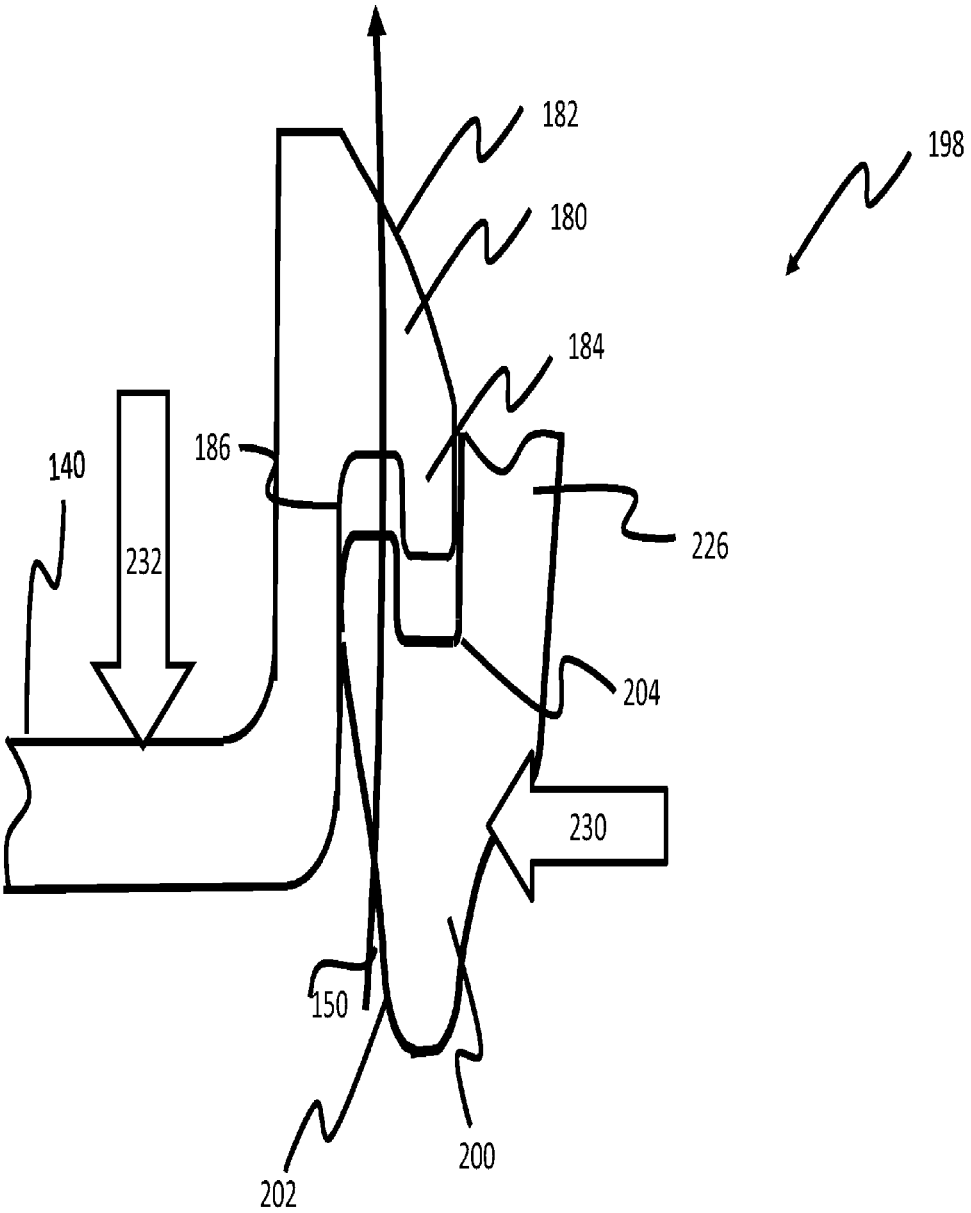
FIG. 11 illustrates another other embodiment of a latching system.

FIG. 11 illustrates another other embodiment of a latching system 198. As is shown in FIG. 11, in this embodiment, housing resilient member 226 positions housing latch 200 in a manner that maintains a bias when housing latch 200 is returned to a location where door latch protrusion 184 can be seated in housing latch channel 204. In the embodiment of FIG. 11, door latch 180 has a latching position contact surface 186. In this embodiment, first bias 230 drives housing contact surface 202 into contact with latching position contact surface 186 after contact between contact surface 202 and contact surface 182 ends. In the embodiment of FIG. 11, door latch 180 and housing latch 200 can be defined so that when latching position contact surface 186 is in contact with contact surface 200 door latch protrusion 184 will be aligned with housing latch channel 204. It will be appreciated that this allows alignment of door latch protrusion 184 and housing latch channel 204 with greater precision. This greater precision can be used for example to allow designers to reduce the extent of any tolerances allotted between door latch protrusion 184 and housing latch channel 204. This, in turn, can increase design flexibility such as by allowing door latch 180 and housing latch 200 to be made smaller as is conceptually illustrated here. Alternatively, the improved precision can be used to allow door latch 180 and housing latch 200 to be made lighter such as by having smaller volume. Alternatively, this can increase design flexibility such as by allowing door latch 180 and housing latch 200 to be made more robust such as by making door latch protrusion 184 and housing latch channel 204 larger.

The described embodiments of firearm associated electronic device 100 provide a rugged and reliable containment system for battery 160 or other separable component, that is resistant to release caused by high levels of transient acceleration that is also resistant to release caused by inadvertent contact and that is also easily accessible when wanted.

The invention has been described in detail with particular reference to certain preferred embodiments thereof, but it will be understood that variations and modifications can be effected within the spirit and scope of the invention.

What is claimed is:

1. A device, comprising:

a housing including:

a mount configured to mount to a firearm, and a first latch having a channel;

a holding area defined by the housing; and a door pivotably coupled to the housing at a location opposite the mount, the door including a second latch, the second latch has a protrusion that at least partially resides within the channel when the first latch and the second latch engage;

the door being moveable between a closed state in which access to the holding area is restricted via an engagement between the first latch and the second latch, and an open state in which access to the holding area is permitted via a disengagement of the first latch and the second latch, wherein:

in the closed state, the door is permitted to extend in a first direction to dispose the protrusion outside of the channel, but while the door is extended in the first direction, the door is restricted from transitioning to the open state so as to not provide access to the holding area, due to the first latch being within the travel patch of the second latch; and biasing the first latch in a second direction while the door is extended in the first direction disposes the first latch outside of the travel path of the second latch and permits the door to transition to the open state.

2. The device of claim 1, wherein the first direction is substantially orthogonal to the second direction.

3. The device of claim 1, further comprising a biasing member, the biasing member being configured to apply a biasing force to a component disposed within the holding area.

4. The device of claim 1, further comprising at least one electrical connection disposed within the holding area.

5. A firearm associated electronic device, comprising:

a housing including:

a mount configured to mount to a firearm at a first portion of the housing, a holding area configured to receive a battery, and a first latch disposed at a second portion of the housing different from the first portion;

a door pivotably coupled to the second portion of the housing, the door including a second latch configured to engage and disengage the first latch;

an electrical connection disposed within the housing and configured to couple to the battery; and a biasing member, wherein:

the biasing member provides a biasing force against the battery to maintain coupling between the battery and the at least one electrical connection; and the biasing force biases the second latch into engagement with the first latch.

6. The firearm associated electronic device of claim 5, wherein:

the door includes a first end and a second end;

the first end is pivotably coupled to the housing; and the second latch is disposed proximal the second end.

7. The firearm associated electronic device of claim 5, wherein the door is moveable between a closed state in which the first latch and the second latch are engaged, and an open state in which the first latch and the second latch are disengaged.

8. The firearm associated electronic device of claim 7, wherein:

in the closed state, the door is permitted to extend in a first direction, but while the door is extended in the first direction, the door is restricted from transitioning to the open state so as to not provide access to the holding area; and biasing the first latch in a second direction while the door is extended in the first direction disposes the first latch outside of a travel path of the second latch and permits the door to transition to the open state.

9. The firearm associated electronic device of claim 5, wherein the second latch is moveable between a first position in which the first latch and the second latch are engaged, and a second position in which the first latch and the second latch are disengaged.

10. The firearm associated electronic device of claim 9, wherein:

the first latch has a channel;

the second latch has a protrusion sized to at least partially reside within the channel;

in the first position, the protrusion is disposed within the channel; and in the second position, the protrusion is disposed outside the channel, but the door is restricted from providing access to the holding area.

11. The firearm associated electronic device of claim 10, wherein biasing the first latch, while the first latch is in the second position, causes the first latch to be disposed outside a travel path of the second latch and permits the door to transition to provide access to the holding area.

12. An attachment for a firearm, comprising:

a housing including a mount configured to couple to the firearm and a bottom location opposite the mount;

a first latch disposed proximate the location;

a holding area defined at least in part by the housing;

a door pivotably coupled to the housing, the door being moveable between an open position in which access to the holding area is permitted and a closed position in which access to the holding area is restricted, the door including a second latch that is configured to engage with the first latch in the closed position; and a biasing member, wherein the biasing member provides a biasing force against a component within the holding area to bias the second latch into engagement with the first latch.

13. The attachment for the firearm of claim 12, wherein:

in the closed position, the door is permitted to extend in a first direction to disengage the first latch and the second latch, but while the door is extended in the first direction, the door is restricted from transitioning to the open position; and biasing the first latch in a second direction while the door is extended in the first direction causes the first latch to be disposed outside a path of the second latch and permits the door to transition to the open position.

14. The attachment for the firearm of claim 13, wherein while the door is extended in the first direction, access to the holding area is restricted due to the first latch being located within the path of the second latch.

15. The attachment for the firearm of claim 12, wherein:

the first latch includes a channel;

the second latch includes a protrusion;

the second latch has a first range of positions in which the protrusion is located within the channel and the door is restricted from transitioning from the closed position to the open position; and the second latch has a second range of positions where the protrusion is located outside the channel, in the second range of positions, access to the holding area is restricted due to the first latch being within a path of the second latch, but while the second latch is in the second range of positions, the door is permitted to transition from the closed position to the open position via a biasing force applied to the first latch.

16. The attachment for the firearm of claim 12, wherein:

the door includes a first end and a second end;

the first end is pivotably coupled to the housing; and the second latch is disposed proximal to the second end.

* * * * *